US006607871B1

(12) United States Patent
Obayashi et al.

(10) Patent No.: US 6,607,871 B1
(45) Date of Patent: Aug. 19, 2003

(54) IMAGE RECORDING MEDIUM

(75) Inventors: Tatsuhiko Obayashi, Kanagawa (JP); Atsuhiro Ookawa, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 74 days.

(21) Appl. No.: 09/666,795

(22) Filed: Sep. 21, 2000

(30) Foreign Application Priority Data

Sep. 27, 1999 (JP) ..... 11-273158

(51) Int. Cl.[7] ..... G03C 1/675; G03C 1/73; B41M 5/26

(52) U.S. Cl. ..... 430/338; 430/340; 430/344; 430/944; 430/342; 430/341; 430/343; 503/201; 503/218; 503/208; 503/209

(58) Field of Search ..... 430/338, 340, 430/344, 944, 964, 342, 341, 343; 503/201, 218, 208, 209

(56) References Cited

U.S. PATENT DOCUMENTS 4,491,432 A * 1/1985 Aviram et al. ..... 400/241.1
4,525,722 A * 6/1985 Sachdev et al. ..... 346/1.1
4,549,824 A * 10/1985 Sachdev et al. ..... 400/241.1
4,720,450 A * 1/1988 Ellis ..... 430/339
5,178,990 A * 1/1993 Satake et al. ..... 430/346
5,192,645 A * 3/1993 Boggs et al. ..... 430/338
5,773,170 A * 6/1998 Patel et al. ..... 430/5
6,100,009 A * 8/2000 Obayashi et al. ..... 430/270.1

FOREIGN PATENT DOCUMENTS

| | | |
|---|---|---|
| JP | 7-164739 | 6/1995 |
| JP | 7-323663 | 12/1995 |
| JP | 8-187948 | 7/1996 |

* cited by examiner

*Primary Examiner*—Cynthia Hamilton
(74) *Attorney, Agent, or Firm*—Sughrue Mion, PLLC

(57) ABSTRACT

An image recording medium comprising a light and heat change material capable of recording an image with laser beam is described, characterized in that therein are incorporated a heat generator having no absorption at a wavelength of 500 nm or more which undergoes exothermic decomposition to amplify heat generation when acted upon by heat and a compound which undergoes thermochemical reaction to show an absorption change at a wavelength of from 360 nm to 900 nm.

5 Claims, No Drawings

IMAGE RECORDING MEDIUM

FIELD OF THE INVENTION

The present invention relates to a high-sensitivity image recording medium comprising a compound which amplifies heat generation by the action of heat.

BACKGROUND OF THE INVENTION

A heat-sensitive recording material shows an image area and a non-image area as a temperature difference distribution. For this recording material, many systems have been devised such as those utilizing melt transfer or sublimation transfer of a colorant, color development reaction of two components by heat fusion or destruction of capsules and change of optical properties by phase inversion. This kind of a heat-sensitive recording medium is advantageous in that it can provide a recorded image in a simple dry system and requires no maintenance. Thus, the heat-sensitive recording medium has been widely used as an output material for various printers, word processors and facsimile machines. With the recent development of laser recording apparatus, the application of the heat-sensitive recording medium to optical disc and plate-making material has been studied. By incorporating a light and heat change material in such an image recording medium, heat mode recording is made possible.

Examples of image recording system utilizing heat generation by irradiation with laser beam include many processes involving the formation of an image by the removal or transfer of a dye such as laser ablation system disclosed in JP-A-7-164755 (The term "JP-A" as used herein means an "unexamined published Japanese patent application"), JP-A-7-149063, and JP-A-7-149065, ablation transfer system disclosed in U.S. Pat. No. 5,171,650. However, these image forming systems are disadvantageous in that dust and waste materials must be disposed off.

On the other hand, besides these physical processes, there has been known a process utilizing the heat generation by laser beam for the color development or decolorization of a compound. A process utilizing the heat development by laser beam for the color development reaction of a leuco dye is disclosed in JP-A-10-337954, JP-A-11-91247, JP-A-11-91248, JP-A-11-91249, JP-A-11-180048, JP-A-11-181031, EP-A-909656, etc. A process utilizing the heat development by laser beam for the color decolorization reaction of a dye is disclosed in JP-A-10-16410, JP-A-8-292517, etc. These systems have no problems of dust and waste materials.

It is said that the temperature developed by the heat generation during irradiation with laser beam in the foregoing laser heat mode system is 1,000° C. or higher. Since the heat generation time is extremely short, a high power laser is required to give a sufficient sensitivity. It is also disadvantageous in that writing speed must be sacrificed to enhance the radiation energy density.

A system utilizing the color development/decolorization reaction of a compound by chemical reaction is disadvantageous in that the enhancement of radiation energy density causes the occurrence of ablation that leads to the occurrence of haze. The industry also has been in a dilemma that when the activation energy of chemical reaction is lowered to enhance sensitivity, it impairs the storage stability of the recording medium. Under these circumstances, it has been desired to develop a technique for maintaining the heat generation during the irradiation with laser beam while controlling the heat generation to a level such that no ablation takes place.

For the foregoing laser ablation system, the heat transfer ink ribbon described in JP-A-58-212625, JP-A-60-178082, and JP-A-60-145892, and the heat-sensitive recording material described in JP-A-7-164739, JP-A-7-323663, and JP-A-8-187948, a sensitivity enhancement technique utilizing a heat-generating compound capable of amplifying the heat generation has been developed. However, there is no reference to the development of such a technique to laser heat mode non-ablation or non-transfer type recording medium (image formation by color development/decolorization utilizing the absorption change of a compound).

SUMMARY OF THE INVENTION

An object of the present invention is to provide a technique for an image recording medium adapted for heat-sensitive recording system, in particular, laser heat mode system utilizing the absorption change of a compound which can attain enhancement of sensitivity of the recording medium without impairing the storage stability thereof and minimize the occurrence of haze due to ablation, thereby forming a sharp image, and provide an effective heat generator.

The objects of the invention are accomplished by the following aspects (1) to (12) of the invention.

(1) An image recording medium capable of recording an image with laser beam comprising a light and heat change material, characterized in that therein are incorporated a heat generator having no absorption at a wavelength of 500 nm or more which undergoes exothermic decomposition to amplify heat generation when acted upon by heat and a compound which undergoes thermochemical reaction to show an absorption change at a wavelength of from 360 nm to 900 nm.

(2) The image recording medium according to Clause (1), wherein the light and heat change material is a dye having absorption in the near infrared region.

(3) The image recording medium according to Clause (1) or (2), wherein the heat generator is a compound which decomposes at a temperature of from 80° C. to 400° C. to generate a heat of 100 J/g or more.

(4) The image recording medium according to any one of Clauses (1) to (3), wherein the heat generator is an ammonium salt of perchloric acid represented by the following general formula (1):

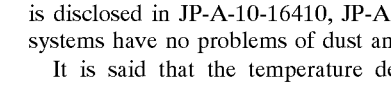

$$R^1R^2R^3R^4N^+ClO_4^- \quad (1)$$

wherein $R^1$, $R^2$, $R^3$ and $R^4$ may be the same or different, each represents a hydrogen atom, alkyl group, aryl group, alkenyl group, alkynyl group, aralkyl group or heterocyclic residue and may be connected to each other to form a ring.

(5) An image recording medium comprising the ammonium salt of perchloric acid represented by the general formula (1) defined in Clause (4) and a compound which undergoes thermochemical reaction to show an absorption change at a wavelength of from 360 nm to 900 nm.

(6) The image recording medium according to any one of Clauses (1) to (5), wherein the compound which shows an absorption change at a wavelength of from 360 nm to 900 nm is a colorless or light-colored leuco dye which undergoes thermochemical reaction induced by heat to develop color.

(7) An image recording medium comprising the heat generator definedin Clause (1), (3) or (4) anda compound which shows an absorption change at a wavelength of from 360 nm to 900 nm with the separation of a substituent caused by the action of heat or an acid.

(8) The image recording medium according to any one of Clauses (1) to (6), wherein the compound which shows an absorption change at a wavelength of from 360 nm to 900 nm is a compound which shows a change in the foregoing absorption range with the separation of a substituent caused by the action of heat or an acid.

(9) An image recording medium comprising the heat generator defined in Clause (1), (3) or (4) and a compound which generates an acid by the action of heat or an acid.

(10) The image recording medium according to Clause (9), wherein the compound which generates an acid by the action of heat or an acid is represented by the following general formula (2):

$$W^1OP^1 \quad (2)$$

wherein $W^1$ represents a moiety to constitute the acid of formula $W^1OH$, and $P^1$ represents a substituent separable by the action of heat or an acid.

(11) The image recording medium according to Clause (10), wherein the compound represented by the general formula (2) is a polymer formed by connecting plural monomers having a partial structure represented by $W^1OP^1$.

(12) The image recording medium according to any one of Clauses (1) to (8), further comprising the compound which generates an acid by the action of heat or an acid defined in any one of Clauses (9) to (11).

DETAILED DESCRIPTION OF THE INVENTION

The present invention will be further described hereinafter.

The heat generator to be incorporated in the image recording medium of the invention is a compound which, when irradiated with laser beam, undergoes exothermic decomposition to allow heat generation to continue, contributing to the enhancement of sensitivity. The image recording medium of the invention utilizes reaction for development or decolorization of color in the range of from 360 nm to 900 nm involving thermochemical reaction. Therefore, when the heat generator itself has absorption in the long wavelength range, the resulting image quality is impaired. Accordingly, as the heat generator there is used herein a compound having no absorption in the wavelength range of 500 nm or more, preferably 400 nm or more, particularly 360 nm or more. The term "thermochemical reaction" as used herein is meant to indicate monomolecular or intermolecular reaction accelerated by heating.

Known examples of such a heat generator include azo compounds, peroxides and atomized isomers having strain (quadricyclane) described in JP-A-58-212625, hyrazones and hydrazides described in JP-A-60-178082, azide compounds described in JP-A-60-145892, and nitroso compounds described in JP-A-7-164739. Any of these compounds may be used in the present invention. Besides these compounds, various useful compounds are described in "Kikenbutsu Handbook (Handbook of Hazardous Materials", Maruzen. Examples of these compounds include nitrogen-containing heterocycles (e.g., tetrazole, triazole), triazines (e.g., 1,3-diphenyltriazine), nitro compounds (e.g., picric acid, trinitrotoluene), and perchlorates (e.g., compounds described later).

The heat generator of the invention may be formed by two or more compounds which undergo exothermic reaction induced by irradiation with laser beam. A preferred example of such a compound is a combination of an acid or base and a compound which undergoes exothermic reaction in the presence of such an acid or base as a catalyst. A specific example of such a combination is a combination of an acid catalyst or compound which generates an acid catalyst when acted upon by heat and a cyclohexanone oxime which exothermically undergoes Beckmann rearrangement in the presence of an acid catalyst or N,N'-dinitrosopentamethylenetetramine described in JP-A-8-187948.

Useful among these heat generators is a compound which undergoes exothermic decomposition at a temperature of from 80° C. to 400° C. to generate a heat of 100 J/g or more, preferably from 150 to 600 J/g, particularly from 200 to 500 J/g.

Specific preferred examples of such a compound employable herein include sulfonylhydrazides (e.g., toluenesulfonyl hydrazide, benzenesulfonylhydrazide, methanesulfonyl hydrazide), and perchlorates. Particularly preferred is an ammonium salt of perchloric acid represented by the following general formula (1):

$$R^1R^2R^3R^4N^+ClO_4^- \quad (1)$$

wherein $R^1$, $R^2$, $R^3$ and $R^4$ may be the same or different, each represents a hydrogen atom, alkyl group (including those containing substituents, preferably having from 1 to 40 carbon atoms, e.g., methyl, ethyl, t-butyl, trifluoromethyl, chloromethyl, dimethylaminomethyl, allyl), aryl group (including those containing substituents, preferably having from 6 to 40 carbon atoms, e.g., phenyl, naphthyl, 4-dimethylaminophenyl, 2-methoxyphenyl, 4-nitrophenyl, 3-sulfophenyl), alkenyl group (including those containing substituents, preferably having from 2 to 40 carbon atoms, e.g., vinyl, 2-chlorovinyl, 2-dimethylaminovinyl, 2-phenylvinyl, 1-methylvinyl, allyl), alkynyl group (including those containing substituents, preferably having from 2 to 40 carbon atoms, e.g., ethynyl, 1-propynyl), aralkyl group (including those containing substituents, preferably having from 7 to 40 carbon atoms, e.g., benzyl) or heterocyclic residue (including those containing substituents, preferably having from 1 to 40 carbon atoms, e.g., 2-pyridyl, 1-imidazolyl, benzothiazole-2-il, morpholino, benzoxazole-2-il, 6-hexadecylsulfonylamino benzothiazole-2-il) and may be connected to each other to form a ring. Examples of $R^1R^2R^3R^4N^+$, if $R^1$, $R^2$, $R^3$ and $R^4$ are connected to each other, include pyridinium ion, quinolinium ion, quinazolinium ion, picolinium ion, and quinoxalinium ion.

Preferred among these embodiments are those wherein $R^1$ to $R^4$ each represents a substituent other than hydrogen atom, particularly alkyl group.

These ammonium salts of perchloric acid are useful in the enhancement of sensitivity in the laser heat mode system as well as in the heat-sensitive recording system such as thermal head recording system utilizing the development/decolorization of color of compounds. In other words, the present invention provides an image recording medium comprising an ammonium salt of perchloric acid represented by the foregoing general formula (1) and a compound which undergoes thermochemical reaction to show an absorption change at a wavelength of from 360 nm to 900 nm.

Preferred examples of the heat generator employable herein will be given below, but the present invention should not be construed as being limited thereto.

(A-1) $(CH_3CH_2CH_2CH_2)_4\overset{\oplus}{N}\,ClO_4^{\ominus}$
(A-2) $(CH_3CH_2)_4\overset{\oplus}{N}\,ClO_4^{\ominus}$
(A-3) $(CH_3)_4\overset{\oplus}{N}\,ClO_4^{\ominus}$
(A-4)
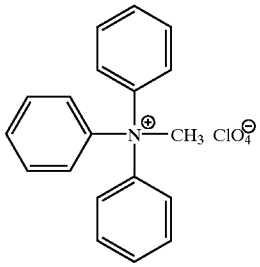
(A-5)
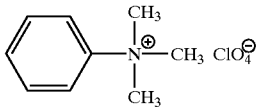
(A-6)
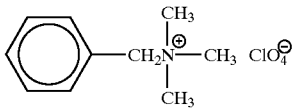
(A-7)
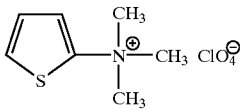
(A-8)
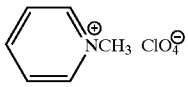
(A-9)
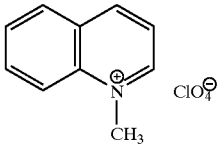
(A-10)
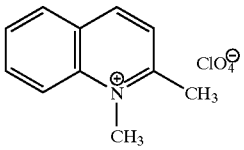
(A-11)
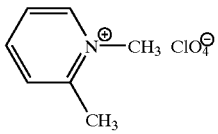
(A-12)
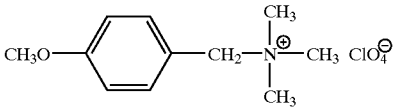
(A-13)
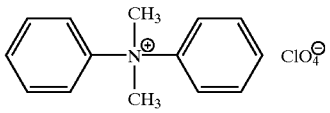
-continued
(A-14)
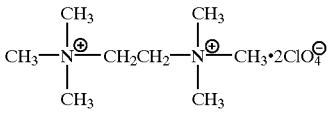
(A-15)
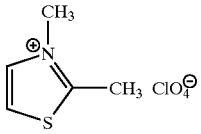
(A-16)
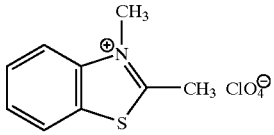
(A-17)
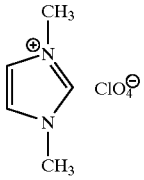
(A-18)
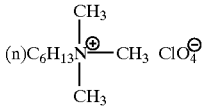
(A-19)
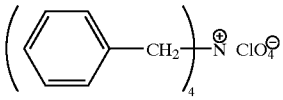
(A-20)
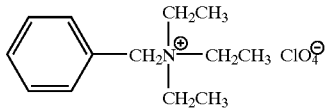
(A-21)
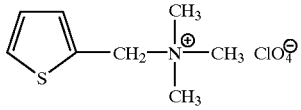
(A-22)
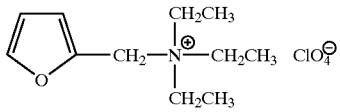
(A-23)
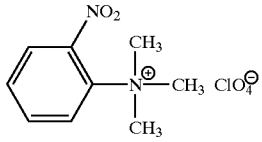
(A-24)
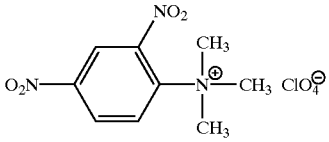

-continued (A-25)

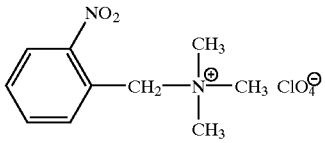

(A-26)

$(CH_3CH_2CH_2CH_2)_3\overset{\oplus}{N}H\ ClO_4^{\ominus}$ (A-27)

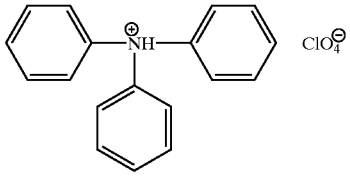

(A-28)

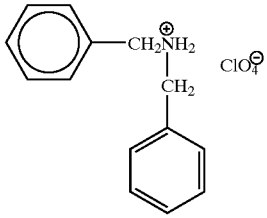

(A-29)

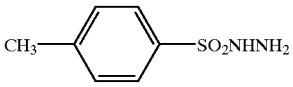

(A-30)

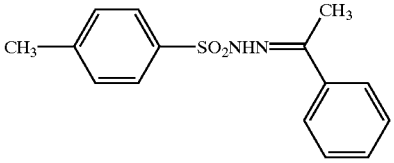

(A-31)

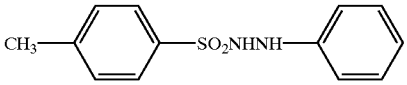

(A-32)

$CH_3SO_2NHNH_2$ (A-33)

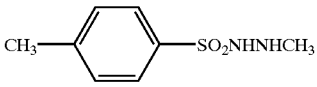

(A-34)

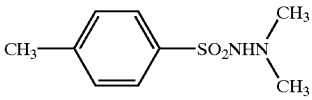

(A-35)

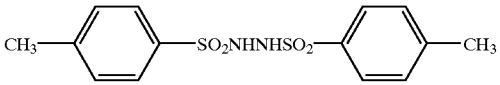

(A-36)

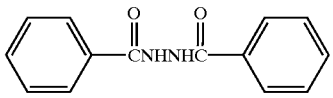

(A-37)

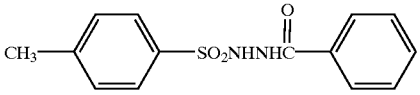

-continued (A-38)

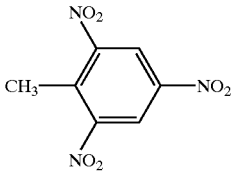

(A-39)

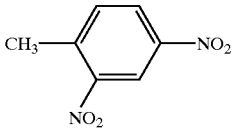

(A-40)

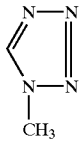

(A-41)

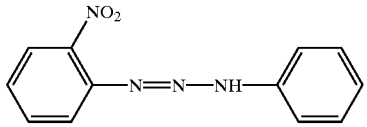

(A-42)

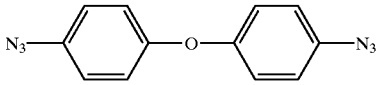

In the present invention, by properly adjusting the added amount of the foregoing heat generator, the sensitivity can be enhanced while inhibiting the occurrence of haze due to ablation. Ablation is attributed to bond cleavage that takes place when an energy instantaneously exceeding the threshold value is supplied. Even when continuous heat generation occurs at a temperature of lower than the threshold value, no ablation occurs. The foregoing heat generator generates heat in a manner that can be said "continuously" as compared with the time during which the image recording medium is irradiated with laser beam. The optimum amount of the heat generator to be added depends on the amount of heat generated during the decomposition of the heat generator, the energy density of the laser beam with which the image recording medium is irradiated, the kind of materials, binder and protective layer participating in the image formation, etc. In general, it is from 0.1 to 100% by weight, preferably from 1 to 50% by weight, particularly from 1 to 30% by weight based on the total weight of an image-forming layer.

The image formation reaction according to the invention involves a type utilizing the change of absorption of a compound within the wavelength range of from 360 nm to 900 nm due to thermochemical reaction. As such a thermochemical reaction there may be used any known technique using a laser heat mode image recording medium or heat-sensitive recording material. Examples of these techniques include one utilizing the color decolorization of dye as described in JP-A-10-16410 and JP-A-8-292517, one utilizing the color development of colorless or light-colored leuco dye as described in EP-A-909656, JP-A-11-180048, JP-A-11-181031, JP-A-11-91247, JP-A-11-91248, JP-A-11-91249, U.S. Pat. Nos. 4,602,263, 4,826,976, and 5,243,052, which concern the utilization of leuco dye which develops color with the separation of substituents when acted upon by heat or an acid, one utilizing the absorption change due to rearrangement reaction as described in JP-A-10-337954, one utilizing the reaction of an electron-donating leuco dye with an electron-receiving color developer as described in JP-B-43-4160 (The term "JP-B" as used herein means an "examined Japanese patent publication") and JP-A-45-14039, and one utilizing the deposition of silver image by thermal reduction reaction of silver ion as described in JP-A-6-194781.

Among the foregoing image recording media, the color decolorization type image recording medium is disadvantageous in that when the reaction does not proceed by 100%, the dye remains in the image area. In the present invention, the color development type image recording medium is particularly desirable.

In the present invention, the system utilizing the color development of colorless or light-colored leuco dye is desirable. In particular, as the recording system suitable for laser heat mode system there is preferably used one involving the color development of a leuco dye by the thermal decomposition or acid catalyst decomposition of substituents incorporated in the leuco dye. An example of such a recording system is one involving the irradiation of an image recording medium containing a leuco dye such as 2-hydroxyphenylbenzotriazole derivative, reduced indigo, quinophthalon derivative, phenothiazine derivative and phenoxazine derivative substituted by alkoxycarbonyl group, alkoxymethyl group, silyl group, acyl group or the like with laser beam leading to color development. For the details of these leuco dyes and image recording systems, referece can be made to EP-A-909656, JP-A-11-180048, JP-A-11-181031, JP-A-11-91247, JP-A-11-91248 and JP-A-11-91249.

In order to accelerate the color development of leuco dye, a recording system is particularly desirable involving the simultaneous addition of a compound which generates an acid by the action of heat or an acid (an acid generato). During this procedure, the image recording medium which has been irradiated with laser beam may be entirely heated during development so that the decomposition of the leuco dye by an acid catalyst can sufficiently proceed. For the details of such an image recording process and acid generator, reference can be made to EP-A-909656, JP-A-11-180048 and JP-A-11-181031. By incorporating a heat generator in these recording media, the efficiency in the generation of an acid during irradiation with laser beam can be drastically enhanced, making it possible to enhance the sensitivity.

When a heat generator is used together in the image recording system (as disclosed in JP-A-4-219283) which comprises thermally decomposing an acid generator during the image recording with a heat-sensitive head to allow an acid-sensitive leuco dye to develop color, the sensitivity can be enhanced, and the storage stability can also be improved because an acid generator having higher thermal decomposition temperature can be used. Accordingly, the use of the heat generator is advantageous in that the sensitivity is compatible with the storage stability.

Examples of compounds useful for the present invention which generate an acid by the action of heat or an acid (acid generators) are particularly compounds represented by the general formula (2).

$W^1$ in the compounds represented by the general formula (2) represents a moiety to constitute an acid represented by formula $W^1OH$ (including sulfonic acids, carboxylic acids, phosphoric acids and phenols). It is desirable for $W^1OH$ to be an acid having a pKa value of 3 or below. Suitable examples of such an acid include an arylsulfonic acid, an alkylsulfonic acid, an electron-attracting group-attached carboxylic acid, an arylphosphonic acid and an alkylphosphonic acid.

$P^1$ in the compounds represented by the general formula (2) represents a substituent which can be separated by the action of heat or an acid. By the separation of $P^1$, the acid represented by $W^1OH$ is produced from the acid generator represented by $WOP^1$. Examples of such a substituent include an alkyl group having a hydrogen atom at the β-position (such as tetrahydropyranyl, tetrahydrofuranyl, t-butyl, cyclohexyl, 4,5-dihydro-2-methylfuran-5-yl or 2-cyclohexenyl group), an alkoxycarbonyl group having a hydrogen atom at the β-position (such as t-butoxycarbonyl, cyclohexyloxycarbonyl, 2-(2-methyl)butoxycarbonyl, 2-(2-phenyl)propyloxycarbonyl or 2-chloroethoxycarbonyl group), a silyl group (such as trimethylsilyl, triethylsilyl, t-butyldimethylsilyl or phenyldimethylsilyl group) and substituents the separation of which are triggered by the decomposition of the group as recited above or an acetal, a ketal, a thioketal, a pinacol or an epoxy ring (for example, groups introduced into acid generators as disclosed in JP-A-8-248561, etc.). Preferred example of such a substituent includes an alkyl group having a hydrogen atom at the β-position.

These compounds can be synthesized by a method which comprises reacting an acid halide and an alcohol corresponding thereto in the presence of a base such as pyridine.

The acid generator represented by the general formula (2) according to the present invention may be a polymer formed by connecting plural polymerizable groups which each is introduced into the acid generator at its substitutable position. The acid generator in the form of a polymer can be applied without using the other binder, that is advantageous for decreasing the thickness of an image recording medium. The molecular weight of the polymer is preferably from 1,000 to 1,000,000, particularly from 2,000 to 300,000. The polymer may be a homopolymer or a copolymer with the other monomer.

The polymers for use in the present invention can be synthesized using various polymerization methods, such as solution polymerization, precipitation polymerization, suspension polymerization, bulk polymerization and emulsion polymerization. For the initiation of polymerization, a method of using a radical initiator or a method of irradiating with light or radiation can be adopted. Those methods for polymerization and initiation of polymerization are described in books, e.g., Teiji Tsuruta, *Kobunshi Gosei Hoho* (which means "Methods of Synthesizing Polymers", revised edition, Nikkan Kogyo Shinbun-sha (1971), and Takayuki Otsu & Masayoshi Kinoshita, *Kobunshi Gosei no Jikkenho* (which means "Experimental Methods for Polymer Synthesis"), pages 124–154, Kagaku Dojin (1972).

Of the foregoing polymerization methods, the solution polymerization using a radical initiator is preferred over the others. As to the solvent used in the solution polymerization, various organic solvents, such as ethyl acetate, methanol, ethanol, 1-propanol, 2-propanol, 1-butanol, acetone, dioxane, N,N-dimethylformamide, N,N-dimethylacetamide, benzene, toluene, acetonitrile, methylene chloride, chloroform and dichloroethane, can be used independently, in combination with two or more thereof, or as a mixture with water.

The polymerization temperature is required to be determined depending on the desired molecular weight of the polymer to be produced and the kind of the polymerization initiator used. Usually the polymerization is carried out at a temperature ranging from 30° C. to 100° C. However, it is desirable for the polymerization to be performed in the temperature range of 30° C. to 90° C., because the monomers having a heat-acid generating function have the possibility of decomposition at high temperature.

Suitable examples of a radical initiator used in the polymerization include an initiator of azo type, such as 2,2'-azobisisobutyronitrile, 2,2'-azobis(2,4-dimethylvaleronitrile), 2,2'-azobis(2-amidinopropane) dihydrochloride or 4,4'-azobis(4-cyanopentanoic acid), and an initiator of peroxide type, such as benzoyl peroxide, t-butyl hydroperoxide or potassium persulfate (which may be used, e.g., as a redox initiator in combination with sodium bisulfite). Of these initiators, the initiators which have the half-decay time of 10 hours at a temperature of 70° C. or below (e.g., 2,2'-azobis(2,4-dimethylvaleronitrile), 2,2'-azobis(4-methoxy-2,4-dimethylvaleronitrile), dimethyl 2,2-azobis(2-methylpropionate), 2,2'-azobis[2-(3,4,5,6-tetrahydro-propane)dihydrochloride]) are preferred over the others.

The suitable amount of polymerization initiator used, though it can be controlled depending on the polymerizability of monomers and the molecular weight required for the polymer produced, is from 0.01 to 5.0 mole % to the monomers.

In the syntheses of the polymers for use in the present invention, an initiator may be thrown into a reaction vessel in which the monomer having a structure represented by the general formula (2) and, if necessary, a copolymerizable monomer are placed in advance, or the polymerization may be carried out via the process of dripping the monomers into a polymerization solvent.

The specific examples of the useful compounds which generate an acid by the action of heat or an acid used in the present invention are illustrated below, but the present invention should not be construed as being limited thereto.

S-(1)

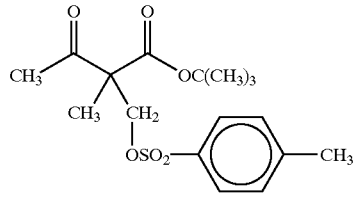

S-(2)

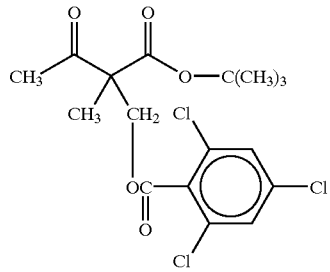

S-(3)

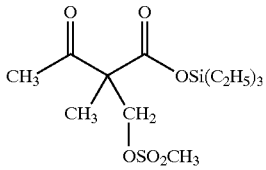

S-(4)

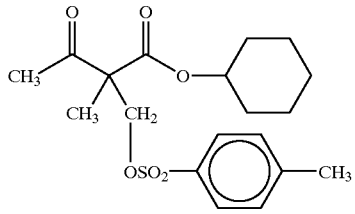

S-(5)

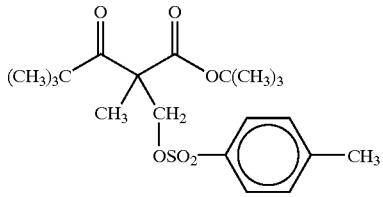

S-(6)

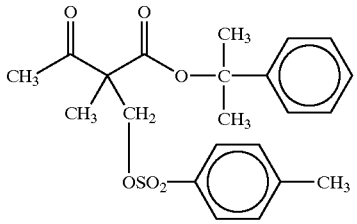

S-(7)

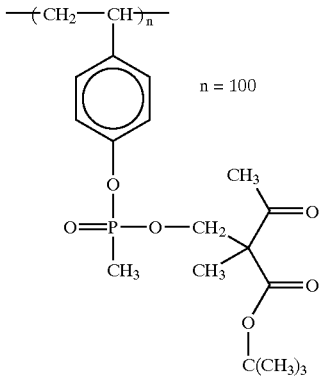

S-(8)

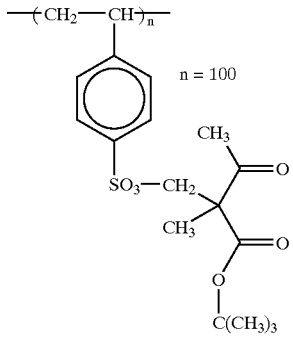

-continued
(Compound disclosed in JP-A-11-180048)
S-(9)
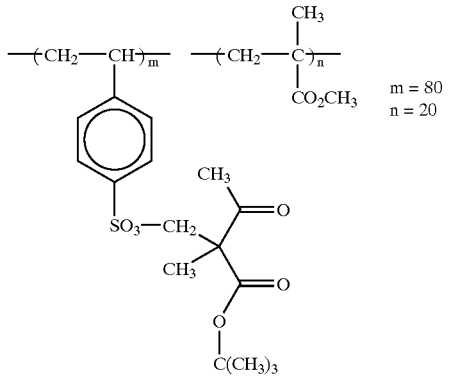
S-(10)
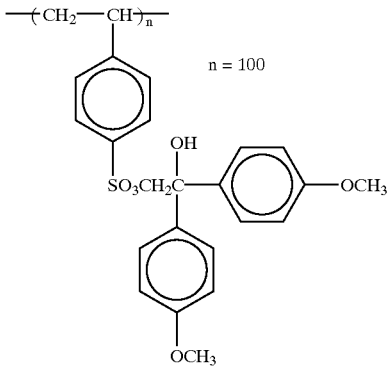
S-(11)
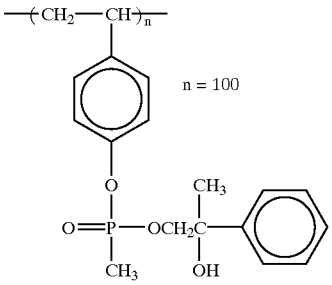
S-(12)
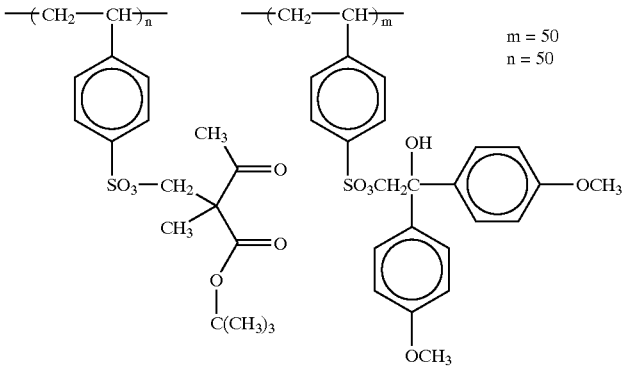
S-(13)
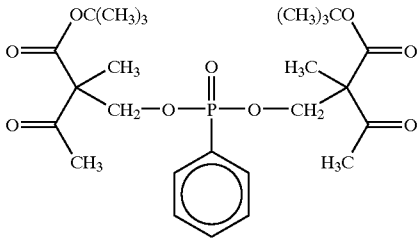

-continued
S-(14)
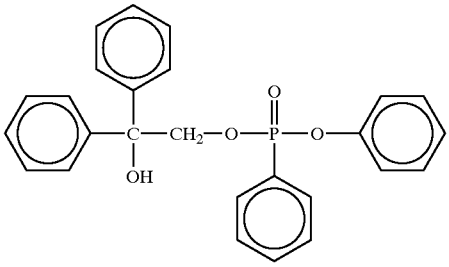
S-(15)
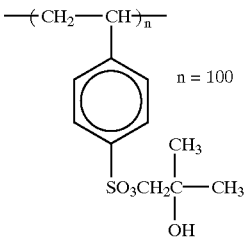
S-(16)
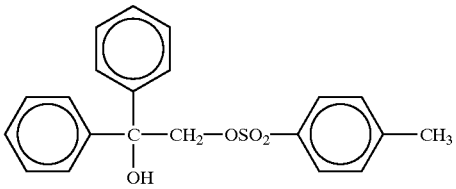
S-(17)
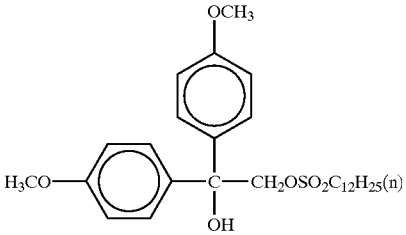
S-(18)
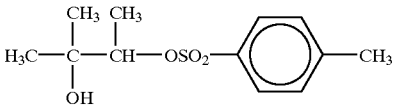
S-(19)
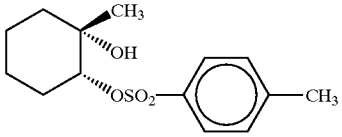
$W^2—O—(CH_2)_n—OP^2$
| | $W^2$ | n | $P^2$ |
|---|---|---|---|
| S-(20) | 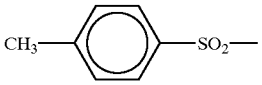 | 4 | 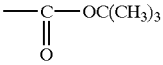 |
| S-(21) | " | 4 | $—CH_2OC_8H_{17}$ |
| S-(22) | " | 4 | $—Si(CH_3)_2C(CH_3)_3$ |
| S-(23) | 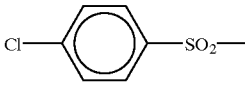 | 4 | 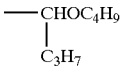 |
| S-(24) | $C_8H_{17}SO_2—$ | 4 | 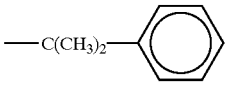 |
| S-(25) | 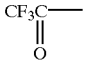 | 5 | $—CH_2OC_{12}H_{25}$ |

-continued
| | | | |
|---|---|---|---|
| S-(26) | 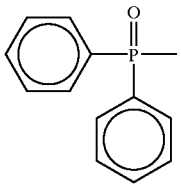 | 4 | " |
| S-(27) | 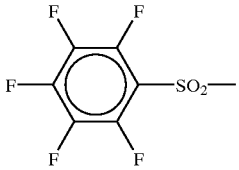 | 5 | " |
S-(28)
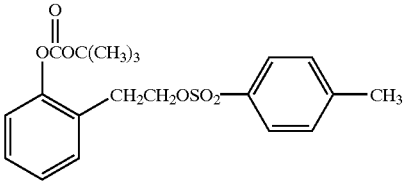
S-(29)
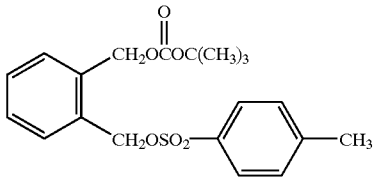
S-(30)
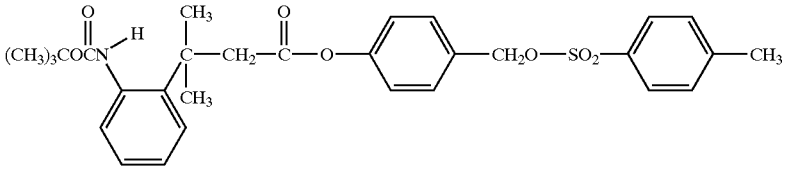
S-(31)
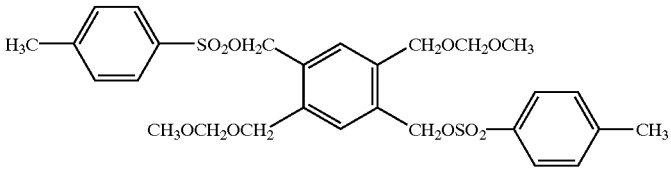
S-(32)
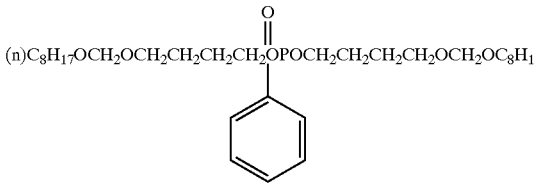
S-(33)
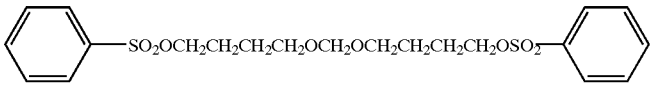

-continued
S-(34)
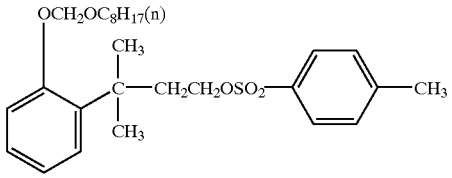
S-(35)
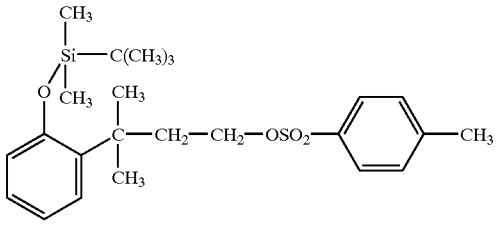
S-(36)
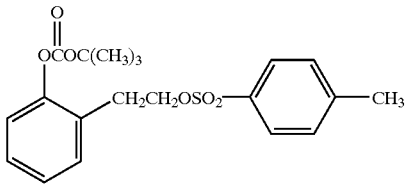
S-(37)
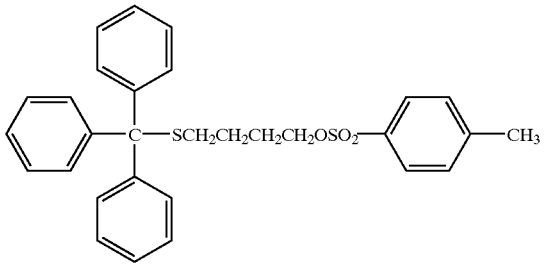
S-(38)
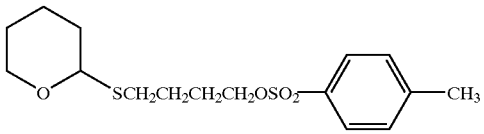
S-(39)
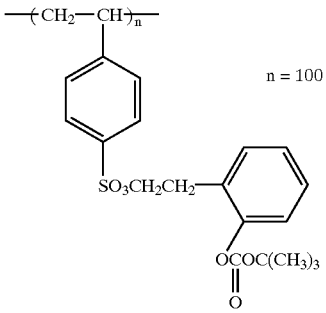

-continued
S-(40)
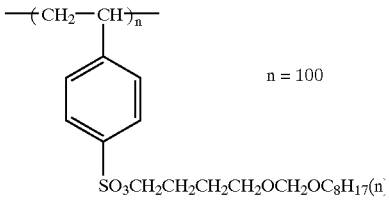
S-(41)
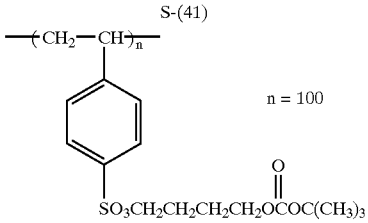
S-(42)
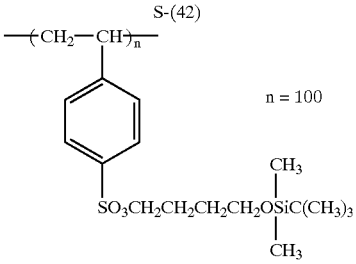
S-(43)
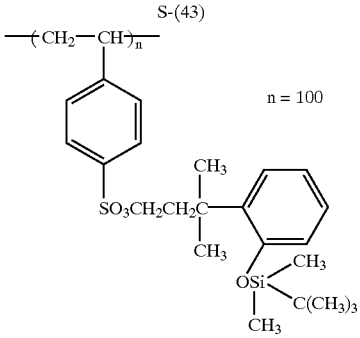
S-(44)
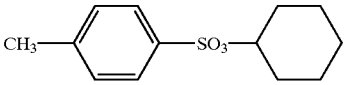
S-(45)
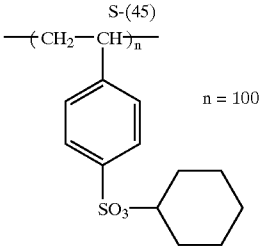
S-(46)
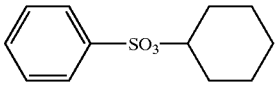

-continued

S-(47)

$CF_3COOCH(CH_3)_2$

S-(48)

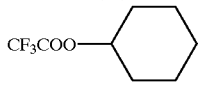

S-(49)

$CF_3COOC(CH_3)_3$

S-(50)

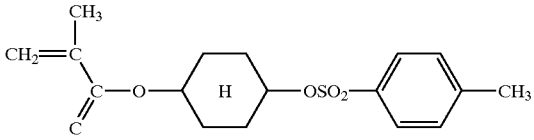

S-(51)

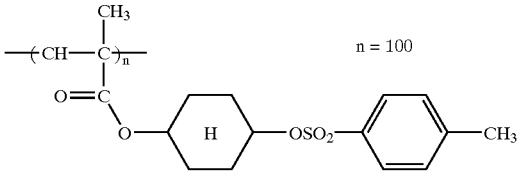

S-(52)

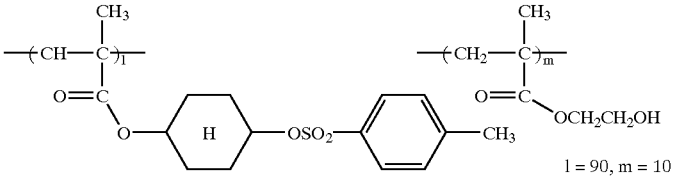

S-(53)

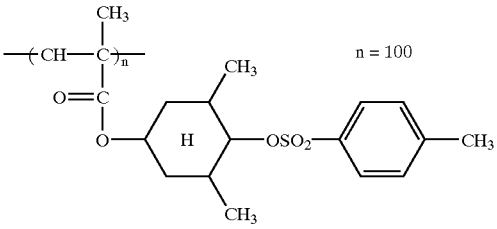

S-(54)

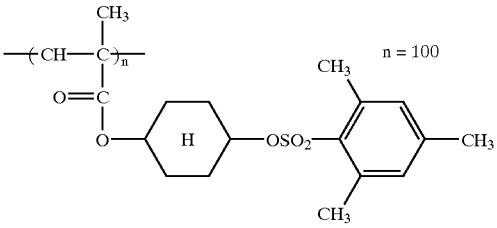

The term "light and heat change material" as used herein is meant to indicate a material which absorbs laser beam as an energy and then convert it to heat. Examples of such a light and heat change material include dyes which absorb according to the wavelength of laser beam, and inorganic fine particles such as carbon black. In the present inventions the system involving the addition of a dye, particularly a near infrared absorption dye corresponding to the beam wavelength of inexpensive semiconductor laser, is desirable. Examples of such a near infrared absorption dye include cyanine dye, squarilium dye, melocyanine dye, oxonol dye, and phthalocyanine dye. These near infrared absorption dyes may be selected depending on the oscillation wavelength of laser used. Specific examples of such a near infrared absorption dye include those described in U.S. Pat. Nos. 4,973,572, 4,948,777, 4,950,640, 4,950,639, 4,948,776, 4,948,778, 4,942,141, 4,952,552, 5,036,040, and 4,912,083.

The amount of the light and heat change material to be added depends on the light and heat change efficiency of the compound, etc. Inpractice, however, the light andheat change material is added in an amount such that the absorbance of the recording medium in the oscillation wavelength of laser is from 0.1 to 10, preferably from 1 to 5, particularly from 2 to 5.

The image recording medium of the invention adapted for laser heat mode can be usually prepared by a process which comprises applying as main components the foregoing heat generator, light and heat change material and compound which undergoes thermochemical reaction to show an absorption change within the range of from 360 nm to 900 nm. However, in the heat-sensitive recording system such as thermal head recording using a heat generator, no near infrared absorption dyes are used.

In the foregoing procedure, the coating material usually comprises a binder incorporated therein except in the case where any of these components is a polymer or an amorphous material having a good coatability. In order to protect the image-forming layer, a protective layer may be provided. The ease of occurrence of ablation can change with the selection of these arrangements. Therefore, the amount of the heat generator to be added needs to be controlled depending on the ease of occurrence of ablation.

The binder to be incorporated in the image-forming layer and protective layer of the invention is not specifically limited so far as it is a colorless medium capable of forming a transparent or semi-transparent film. Examples of such a medium employable herein include water-soluble binders such as gelatin, casein, starch, hydroxyethyl cellulose, carboxymethyl cellulose, polyvinyl alcohol, polyacrylamide and ethylene-maleic anhydride copolymer, and water-insoluble binders such as polyvinyl butyral, triacetyl cellulose, cellulose acetate butyrate, polyester, polycarbonate, polyvinylester (e.g., polyvinyl acetate), polystyrene, polyvinyl chloride and acrylic acid ester (co) polymer and methacrylic ester (co)polymer (e.g., methyl methacrylate-hydroxymethyl methacrylate copolymer, methyl acrylate-butadiene copolymer, polymethyl methacrylate, poly-t-butyl methacrylate, acrylonitrile-butadiene copolymer).

Preferred among these binders are water-insoluble binders. A film may be formed from the water-insoluble binder in an organic solvent. Alternatively, a film may be formed in the form of an aqueous dispersion of the water-insoluble binder. The term "aqueous dispersion" as used herein is meant to indicate a fine dispersion of a water-insoluble hydrophobic polymer in a water-soluble dispersion medium.

The mode of dispersion may be any of emulsion of polymer in a dispersant, emulsion polymerized product, micelle dispersion of polymer and molecular dispersion of molecular chain of polymer having a partial hydrophilic structure. Examples of these polymer dispersions are described in Taira Okuda and Hiroshi Inagaki, "Gosei Jushi Emulsion (Synthetic Resin Emulsion)", Kobunshi Kankokai, 1978, Takaaki Sugimura, Yasuo Kataoka, Soichi Suzuki, Keiji Kasahara, "Gosei Latex no Ouyo (Application of Synthetic Latex)", Kobunshi Kankokai, 1993, and Soichi Muroi, "Gosei Latex no Kagaku (Chemistry of Synthetic Latex)", Kobunshi Kankokai, 1970. The average diameter of dispersed particles is from about 1 to 50,000 nm, preferably from about 5 to 1,000 nm. The distribution of diameter of dispersed particles is not specifically limited. The dis persed particles may be widely distributed or monodisperse.

The molecular weight of the polymer to be incorporated in the image recording layer and protective layer is from about 1,000 to 1,000,000, preferably from about 20,000 to 500,000 as calculated in terms of weight-average molecular weight. These polymers may be used singly. If necessary, a blend of two or more polymers may be used.

Two or more protective layers may be provided as necessary. The amount of binder to be incorporated in these protective layers is from 0.2 to 5.0 g/m$^2$, preferably from 0.5 to 3.0 g/m$^2$.

The image recording m edium of the invention may comprise a back layer provided on the back surface of the support or may comprise a single or plural subbing layers made of pigment or resin provided between the image recording layer and the supp ort besides the protective layer. The back layer or subbing layer adjacent to the support preferably comprises a metal oxid e incorporated therein to minimize the attraction of dust. At least one of the back layer and the subbing layer (provided on both surfaces of the support) is preferably electrically conductive.

As the metal oxide to be used herein, one described in JP-A-61-20033 and JP-A-56-82504 is particularly desirable.

The amount of the electrically-conductive metal oxide to be used is preferably from 0.05 to 20 g, particularly from 0.1 to 10 g per m$^2$ of the image recording material used. The surface resistivity of the metal oxide-containing layer is $10^{12}$ Ω or less, preferably 1011 Ω or less in an atmosphere of 25° C. and 25% RH. In this arrangement, good antistatic properties can be obtained. The lower limit of the surface resistivity is not specifically limited. Inpractice, however, it is about $10^7$ Ω.

These layers may each comprise a crosslinking agent for crosslinking the material and a surface active agent for improving the coatability thereof. In addition, various known techniques for heat-sensitive recording material may be used.

As the matting agent to be used in the invention there may be used any fine solid particle which has no adverse effect on the various photographic properties. Examples of inorganic matting agent include silicon dioxide, oxide of titanium, oxide of aluminum, carbonate of zinc, carbonate of calcium, sulfate of barium, sulfate of calcium, silicate of calcium, and silicate of aluminum. Examples of organic matting agent include organic polymers such as cellulose ester, polymethyl methacrylate, polystyrene, polydivinylbenzene and copolymer thereof. The matting agent is preferably incorporated in the outermost protective layer mostly remote from the support on the image-forming layer side of the image recording medium. On the opposite side, the matting agent is preferably incorporated in the back layer which is not an outermost layer.

In the present invention, the average particle diameter of the matting agent is from 1 to 10 μm.

In the present invention, the amount of the matting agent to be added is preferably from 5 to 400 mg/m$^2$, particularly from 10 to 200 mg/m$^2$.

In the invention, there are preferably used a porous matting agent described in JP-A-3-109042, line 8, lower left column, page 2-line 4, upper right column, page 3, a matting agent surface-modified with an alkali described in JP-A-4-127142, line 7, upper right column, page 3-line 4, lower right column, page 5, and a matting agent made of organic polymer described in JP-A-6-118542, paragraph [0005]–[0026].

Two or more of these matting agents may be used in combination. Examples of such a combination include a combination of an inorganic matting agent and an organic matting agent, a combination of a porous matting agent and a non-porous matting agent, a combination of an amorphous matting agent and a spherical matting agent, and a combination of matting agents having different average particle diameters (e.g., combination of a matting agent having an average particle diameter of 1.5 μm or more and a matting agent having an average particle diameter of 1 μm or less described in JP-A-6-118542).

In the present invention, a so-called monodisperse matting agent having a narrow particle diameter distribution may be preferably used. Such a monodisperse matting agent has a low content of fine particles having little effect of improving the adhesivity resistance an d coarse particles causing problems such as image density drop and thus is favorable for attaining both desired adhesivity resistance and transparency. Preferred examples of monodisperse matting agent employable herein include those described in Research Disclosure No. 21617 (No. 216 (1982)), JP-B-5-59924, British Patent 8,135,262, JP-A-61-230141, EP 610, 522, EP 618,490, and JP-A-8-278587.

In the present invention, the image recording medium preferably comprises a lubricant incorporated in the outermost layer on the image-forming layer side thereof and/or opposite side thereof.

The lubricant to be used in the invention is not specifically limited. Any compound can be used which can reduce the friction coefficient of the surface of a material when it is present on the surface of the material as compared with when it is not present on the material.

Representative examples of the lubricant to be used in the inventio n include silicon e-based lubricants described in U.S. Pat. No. 3,042,522, British Patent 955,061, U.S. Pat. Nos. 3,080,317, 4,004,927, 4,047,958, 3,489,567, and British Patent 1,143,118, higher aliphatic acid-based, alcohol-based and acid amide-based lubricants described in U.S. Pat. Nos. 2,454,043, 2,732,305, 2,976,148, 3,206,311, German Patents 1,284,295 and 1,284,294, metallic soaps described in British Patent 1,263,722, and British Patent 3,933,516, ester-based and ether-based lubricants described in U.S. Pat. Nos. 2,588,765, 3,121,060, and British Patent 1,198,387, and taurine-based lubricant described in U.S. Pat. Nos. 3,502,473 and 3,042,222.

Specific examples of the lubricant which can be preferably used in the invention include Cellosol 524 (main component: carnauba wax), Polylon A, 393, H-481 (main component: polyethylene wax), Himicron G-110 (main component: ethylenebisstearic acid amide), and Himicron G-270 (main component: stearic acid amide) (These products are all available from Chukyo Yushi Co., Ltd.).

The amount of the lubricant to be used is from 0.1 to 50% by weight, preferably from 0.5 to 30% by weight based on the weight of the binder in the layer in which it is incorporated.

If necessary, various additives such as pigment, oxidation inhibitor and sticking inhibitor may be incorporated in the image recording medium of the invention. In addition, various known techniques for heat-sensitive recording material may be employed.

Examples of the pigment, if any, include diatomaceous earth, talc, kaolin, calcined kaolin, titanium oxide, silicon oxide, magnesium carbonate, calcium carbonate, aluminum hydroxide, and urea-formalin resin.

Examples of other additives include ultraviolet absorbers such as benzophenone-based compound and benzotriazole-based compound, head abrasion inhibitors and sticking inhibitors made of metal salt of higher aliphatic acid such as zinc stearate and calcium stearate, and waxes such as paraffin, paraffin oxide, polyethylene, polyethylene oxide and castor wax. These additives may be added as necessary.

Examples of the support to be used in the image recording medium of the invention include paper such as wood free paper, baryta paper, coated paper, cast-coated paper and synthetic paper, polymer film such as polyethylene, polypropylene, polyethylene terephthalate, polyethylene-2, 6-naphthylene dicarboxylate, polyarylene, polyimide, polycarbonate and triacetyl cellulose, glass, metal foil, and nonwoven fabric.

In the case where the image recording medium of the invention is used for the formation of a transparent image on OHP film, plate-making film, etc., a transparent support is used. When the image recording medium is used as a plate-making film, a support having a small thermal expansion coefficient, a good dimensional stability and no absorption in the wavelength range to which PS plate is sensitive may be selected.

Examples of a method for heating as a means of image formation include a method of bringing a heated block or plate into contact with the image recording medium, a method of bringing a hot roller or drum into contact with the image recording medium, a method of irradiating the image recording medium with a halogen lamp or an infrared or far infrared lamp heater, a method of heating imagewise the image recording medium by means of a thermal head of heat-sensitive printer, and a method of irradiating the image recording medium with laser beams. When the image recording medium of the present invention is used for the use which requires high resolution such as a plate making material, a scan exposure system with laser beams is preferred. With the intention of forming images with less thermal energy, it is also possible to heat in advance the image recording medium at an appropriate temperature. In the case where the image recording medium of the invention comprises a heat-acid generator incorporated therein and separates a substituent of a leuco dye by an acid catalyst generated by irradiation with laser beam to allow the dye to develop color, the image recording medium which has been irradiated with laser beam can be entirely heated at appropriate temperature to amplify the image. It is essential that the temperature at which the image recording medium is entirely heated be such that the acid generator or heat generator at the non-image area does not decompose. In the case where the image recording medium is used as a plate making material, the temperature must be such that the dimensional stability of the base can be assured. The heat development temperature in the invention is preferably from 60° C. to 150° C., particularly from 80° C. to 120° C.

Examples of laser beam source employable herein include eximer laser, argon laser, helium neon laser, semiconductor laser, glass (YAG) laser, carbon dioxide gas laser, and dye laser. Useful among these laser beam sources are helium neon laser, semiconductor laser, and glass laser. Particularly useful among these laser beam sources is semiconductor laser because of its small size and inexpensiveness.

The present invention will be further described in the following examples, but the present invention should not be construed as being limited thereto.

SYNTHESIS EXAMPLE 1

Synthesis of Compound (LD-1) {Leuco Dye}

To 4.5 g of quinoline-N-oxide monohydrate was added 4.16 g of acetic anhydride. The mixture was then stirred at room temperature for 1 hour. As a result, the system became uniform. To the solution was then added a suspension of 3.9 g of 3-isopropylisoxazolone in 10 ml of chloroform. The mixture was then stirred at room temperature for 3 hours. The reaction solution was washed with water, and then dried over magnesium sulfate so that it was concentrated. To the resulting oil-like material was then added methanol. The mixture was then stirred to obtain 1.2 g of a lemon yellow dye ($\lambda$max=424 nm (in ethyl acetate)).

Subsequently, 1 g of the dye thus obtained was dissolved in 10 ml of THF. To the solution thus obtained was then added 157 mg of an oil dispersion of hydrogenated sodium (content: 60%). To the solution was then added 0.76 ml of chloromethyloctyl ether. The mixture was then stirred at room temperature for 3 hours. To the reaction solution was then added ethyl acetate. The reaction solution was washed with water so that the organic layer was extracted. The organic layer thus extracted was dried over magnesium sulfate so that it was concentrated. The resulting oil-like material was then purified through silica gel column chromatography (developing solvent: 3/1 mixture of n-hexane and ethyl acetate) to obtain 300 mg of Compound (LD-1) in the form of colorless crystal (λmax=340 nm (in ethyl acetate)).

(LD-1)

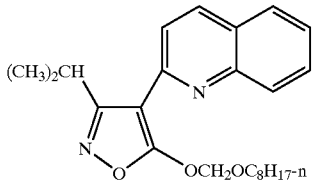

SYNTHESIS EXAMPLE 2

Synthesis of Compound (LD-2) {Leuco Dye}

Compound (LD-2) was synthesized in the same manner as in Synthesis Example 1. Compound (LD-2) exhibited λmax of 340 nm (in ethyl acetate). The product of color development of this compound exhibited λmax of 424 nm (in ethyl acetate)

(LD-2)

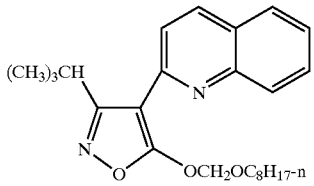

SYNTHESIS EXAMPLE 3

Synthesis of Compound (LD-3) {Leuco Dye}

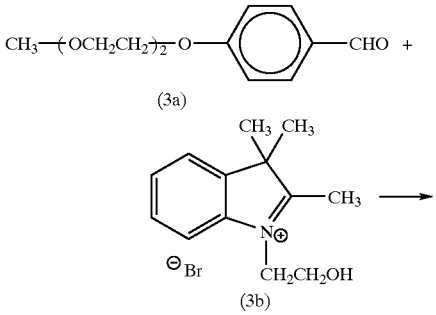

-continued

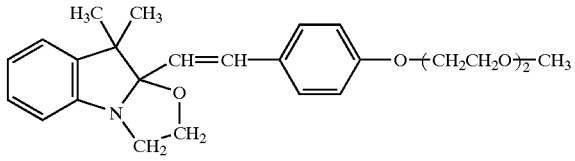

(LD-3)

To a mixed solution of 60 ml of acetic acid and 60 ml of pyridine were suspended 28.6 g of 3a and 36.3 g of 3b. The suspension was then stirred at a temperature of 60° C. for 1 hour. After the reaction solution was poured into 180 ml of 5N aqueous solution of sodium hydroxide while cooled with ice, ethyl acetate was added thereto to extract an organic layer. The organic layer extracted was dried over magnesium sulfate and then it was concentrated under reduced pressure. Further, 200 ml of isopropanol was added thereto and recrystallization gave 35 g of a colorless crystal of LD-3 (The crystal developed color (λmax of 446 nm in chloroform) by adding p-toluene sulfonic acid).

SYNTHESIS EXAMPLE 4

Synthesis of Compound S-(50) {Acid Generator Monomer}

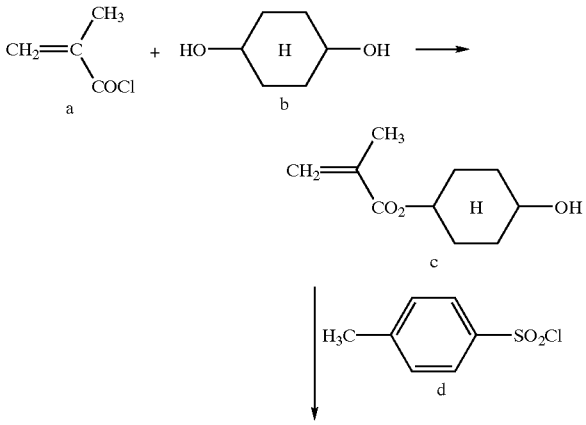

Illustrated Compound S-(50)

b (100 mmol) was dissolved in N,N-dimethylacetamide (50 ml) and a reaction vessel was cooled to 7° C. a (100 mmol) was added dropwise to the vessel in 10 minutes and then the mixture was reacted for 6 hours. After ethyl acetate (200 ml) and water (200 ml) were added thereto and the mixture was stirred, an aqueous layer was separated. Further, an organic layer was washed with 1 mol/l of aqueous hydrogen chloride solution (100 ml) three times, dried over magnesium sulfate and then concentrated. The resulting oil-like material was purified through silica gel column chromatography (elute: ethyl acetate/hexane=1/4→1/1) to obtain c in a 61% yield.

d (50 mmol) was dissolved in pyridine (30 ml) and the mixture was cooled to 7° C. c (50 mmol) was added thereto and then the mixture was stirred for 8 hours. After water (3 ml) was added thereto and the mixture was stirred for 30 minutes, ethyl acetate (100 ml) and water (200 ml) were added thereto, the mixture was stirred, and then aqueous layer was separated. Further, an organic layer was washed with 1 mol/l of aqueous hydrogen chloride solution (100 ml) three times, dried over magnesium sulfate, and then concentrated. The resulting oil-like material was purified through silica gel column chromatography (elute: ethyl acetate/hexane=1/4→1/1) to obtain Illustrated Compound S-(50) as a mixture of a cis-form and a trans-form in a 72% yield. The cis-form and the trans-form can be separated through silica gel column chromatography (elute: ethyl acetate/hexane=1/4→1/1) and the decomposition temperature of each form separated was measured. The decomposition temperatures of the cis-form and the trans-form were 192° C. and 184° C., respectively.

SYNTHESIS EXAMPLE 5

Synthesis of Compound S-(51) {Acid Generator Monomer}

Illustrated Compound S-(50) (50 mmol) was dissolved in toluene (22 ml) and the mixture was heated to 40° C. under a nitrogen atmosphere. After methyl ethyl ketone solution (3 ml) of 2,2'-azobis(4-methoxy-2,4-dimethylvaleronitrile) (0.125 g) was added thereto and the mixture was reacted for 2 hours, methyl ethyl ketone solution (3 ml) of 2,2'-azobis (4-methoxy-2,4-dimethylvaleronitrile) (0.125 g) was further added thereto. After the mixture was reacted for 2 hours, the reaction solution was poured into hexane (1,200 ml). The deposited material was separated by filtration and dried to obtain Illustrated Compound S-(51) in a 89% yield. Weight-average molecular weight of Illustrated Compound S-(51) was 85,000 and the decomposition temperature thereof was 172° C.

EXAMPLE 1

Preparation of Image Recording Medium

The following compounds were each dissolved in chloroform. The solution thus obtained was applied to a polyethylene terephthalate film having a thickness of 100 μm, and then dried to prepare an image recording layer. Further, polyvinyl alcohol dissolved in water was applied as a protective layer on the image recording layer in such a manner that the dry thickness of the protective layer became 1 μm and then dried to prepare an image recording medium. Kuraray Poval PVA 110 manufactured by Kuraray Co., Ltd. was used as polyvinyl alcohol and polystyrene beads (diameter: 3.2 mm) manufactured by Wako Pure Chemical Industries, Ltd. were used as polystyrene.

| | |
|---|---|
| Sample-1 | |
| LD-1 | 1 mmol/m$^2$ |
| S-(8) | 234 mg/m$^2$ |
| A-1 | 0.3 mmol/m$^2$ |
| IR dye | 113 mg/m$^2$ |
| Sample-2 | |
| LD-1 | 1 mmol/m$^2$ |
| S-(8) | 234 mg/m$^2$ |
| A-2 | 0.3 mmol/m$^2$ |
| IR dye | 113 mg/m$^2$ |
| Sample-3 | |
| LD-1 | 1 mmol/m$^2$ |
| S-(8) | 234 mg/m$^2$ |
| A-6 | 0.3 mmol/m$^2$ |
| IR dye | 113 mg/m$^2$ |

-continued

| | |
|---|---|
| Sample-4 | |
| LD-1 | 1 mmol/m$^2$ |
| S-(8) | 234 mg/m$^2$ |
| A-31 | 0.3 mmol/m$^2$ |
| IR dye | 113 mg/m$^2$ |
| Sample-5 | |
| LD-1 | 1 mmol/m$^2$ |
| S-(8) | 234 mg/m$^2$ |
| A-30 | 0.3 mmol/m$^2$ |
| IR dye | 113 mg/m$^2$ |
| Reference Sample-1 | |
| LD-1 | 1 mmol/m$^2$ |
| S-(8) | 234 mg/m$^2$ |
| IR dye | 113 mg/m$^2$ |

IR dye

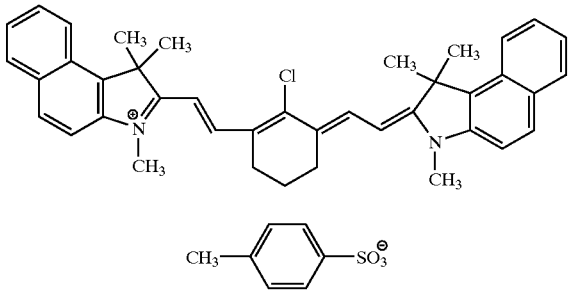

Conditions of Laser Exposure for Image Recording 8 units of Spectra Diode Labs No. SDL-2430 (wavelength range: 800–830 nm) were combined to provide an image writing laser having an output of 400 mW.

The laser was then adjusted to give a laser beam having a diameter of 160 μm. The laser scanning speed was adjusted to 1.25 m/sec (center of scanning). The sample feed speed was adjusted to 15 mm/sec. The scanning pitch was adjusted to 8 units/mm. Under these conditions, the foregoing samples were each subjected to exposure to form an image having a size of 22 mm33 9 mm. The laser energy density on the sample was 2 mJ/mm$^2$.

Samples-1 to 5 and Reference Sample-1 were each subjected to scanning exposure under the foregoing laser exposure conditions, subjected to heat development under the conditions of 115° C. and 10 seconds, and then measured for color density of exposed area at 420 nm. The measurement of densitiy of color developed was carried out by examining transmission density by means of an ultraviolet visible light spectrophotometer (UV2400PC, manufactured by Simadzu Corporation).

The results are set forth in Table 1.

TABLE 1

| Sample No. | Color density |
|---|---|
| Sample-1 (present invention) | 1.10 |
| Sample-2 ( " ) | 0.92 |
| Sample-3 ( " ) | 1.00 |
| Sample-4 ( " ) | 0.72 |
| Sample-5 ( " ) | 0.52 |
| Reference Sample-1 | 0.48 |

As can be seen in Table 1, Samples-1 to 5, which comprise a heat generator incorporated therein, exhibit an enhanced sensitivity as compared with Reference Sample-1. In particular, Samples-1 to 3, which comprise ammonium perchlorate incorporated therein as a heat generator, exhibit an enhanced sensitivity. None of these samples showed haze due to ablation.

EXAMPLE 2

Preparation of Image Recording Medium

The following compounds were each dissolved in chloroform. The solution thus obtained was applied to a polyethylene terephthalate film having a thickness of 100 $\mu$m, and then dried to prepare an image recording medium.

| | |
|---|---|
| Sample-6 | |
| LD-2 | 2 mmol/m$^2$ |
| S-(8) | 234 mg/m$^2$ |
| A-1 | 1 mmol/m$^2$ |
| Sample-7 | |
| LD-2 | 2 mmol/m$^2$ |
| S-(8) | 234 mg/m$^2$ |
| A-31 | 1 mmol/m$^2$ |
| Sample-8 | |
| LD-2 | 2 mmol/m$^2$ |
| S-(51) | 215 mg/m$^2$ |
| A-1 | 1 mmol/m$^2$ |
| Sample-9 | |
| LD-3 | 2 mmol/m$^2$ |
| S-(51) | 215 mg/m$^2$ |
| A-1 | 1 mmol/m$^2$ |
| Sample-10 | |
| LD-3 | 2 mmol/m$^2$ |
| S-(51) | 215 mg/m$^2$ |
| A-31 | 1 mmol/m$^2$ |
| Sample-11 | |
| LD-3 | 2 mmol/m$^2$ |
| S-(51) | 215 mg/m$^2$ |
| A-30 | 1 mmol/m$^2$ |
| Reference Sample-2 | |
| LD-2 | 2 mmol/m$^2$ |
| S-(8) | 234 mg/m$^2$ |
| Reference Sample-3 | |
| LD-2 | 2 mmol/m$^2$ |
| S-(51) | 215 mg/m$^2$ |
| Reference Sample-4 | |
| LD-3 | 2 mmol/m$^2$ |
| S-(51) | 215 mg/m$^2$ |

A PET film having a thickness of 20 $\mu$m was adhered to the image-forming layer side of each of Samples-6 to 11 and Reference Samples-2 to 4. Thus obtained samples each was heated to a temperature of 170° C. for 5 seconds in a stationary color development testing machine, and then examined for color density at 420 nm. The results are set forth in Table 2.

TABLE 2

| Sample No. | Color density |
|---|---|
| Sample-6 (present invention) | 2.03 |
| Sample-7 (present invention) | 1.53 |
| Sample-8 (present invention) | 2.12 |

TABLE 2-continued

| Sample No. | Color density |
|---|---|
| Sample-9 (present invention) | 2.52 |
| Sample-10 (present invention) | 2.32 |
| Sample-11 (present invention) | 2.16 |
| Reference Sample-2 | 0.61 |
| Reference Sample-3 | 0.95 |
| Reference Sample-4 | 1.51 |

As can be seen in Table 2, when a heat generator was used together in the above image recording medium adapted for a mode of allowing a leuco dye to develop color by thermal decomposition of the acid generator, the thermal decomposition of acid generator was accelerated and the image recording medium exhibited an enhanced sensitivity (Samples-6 and 7 vs. Reference Sample-2, Sample-8 vs. Reference Sample-3, and Samples-9 to 11 vs. Reference Sample-4).

The use of the image recording medium of the invention adapted for laser heat mode system utilizing the absorption change of a compound makes it possible to attain enhancement of sensitivity without impairing the storage stability thereof and minimize the occurrence of haze due to ablation, thereby forming a sharp image. Further, an effective heat generator can be obtained.

While the invention has been described in detail and with reference to specific embodiments thereof, it will be apparent to one skilled in the art that various changes and modifications can be made therein without departing from the spirit and scope thereof.

What is claimed is:

1. An image recording medium capable of recording an image with laser beam comprising (i) a light and heat change material, (ii) a heat generator having no absorption at a wavelength of 500 nm or longer which undergoes exothermic decomposition to amplify heat generation when acted upon by heat, (iii) a compound which reacts with an acid to show an absorption change at a wavelength of from 360 nm to 900 nm, and (iv) a compound which generates an acid by the action of heat.

2. The image recording medium according to claim 1, wherein said light and heat change material comprises a dye having absorption in the near infrared region.

3. The image recording medium according to claim 1, wherein said heat generator is a compound which decomposes at a temperature of from 80° C. to 400° C. to generate a heat of 100 J/g or more.

4. The image recording medium according to claim 1, wherein said heat generator is an ammonium salt of perchloric acid represented by the following general formula (1):

$$R^1R^2R^3R^4N{+}ClO_4 \quad (1)$$

wherein $R^1$, $R^2$, $R^3$ and $R^4$ maybe the same or different, each represents a hydrogen atom, alkyl group, aryl group, alkenyl group, alkynl group, aralkyl group or heterocyclic residue and may be connected to each other to form a ring.

5. The image recording medium according to claim 1, wherein said compound which shows an absorption change at a wavelength of from 360 nm to 900 nm is a compound which shows a change in the foregoing absorption range with the separation of a substituent caused by reaction with an acid.

* * * * *